United States Patent [19]

Allard

[11] 4,429,746

[45] Feb. 7, 1984

[54] METHOD AND APPARATUS FOR DISPOSING OF DRILLING MUDS AND WASTES GENERATED DURING WELL DRILLING OPERATIONS AND FOR PLUGGING AND ABANDONING THE WELL

[76] Inventor: Gerald D. Allard, 1904 Harbour Dr., Seabrook, Tex. 77586

[21] Appl. No.: 288,214

[22] Filed: Jul. 29, 1981

[51] Int. Cl.[3] ..... E21B 23/00; E21B 33/05; E21B 33/13

[52] U.S. Cl. ..... 166/291; 166/70; 166/156; 166/305 D

[58] Field of Search ..... 166/291, 75 R, 70, 285, 166/153, 156, 84–86, 88, 305 D

[56] References Cited

U.S. PATENT DOCUMENTS

| | | | |
|---|---|---|---|
| 2,346,060 | 4/1944 | Yeatman | 166/291 |
| 2,615,519 | 10/1952 | Carr | 166/70 |
| 2,646,123 | 7/1953 | Nelson | 166/291 X |
| 2,801,077 | 7/1957 | Howard et al. | 166/293 |
| 2,854,079 | 9/1958 | Schnitter | 166/70 |
| 2,876,842 | 3/1959 | McSpadden | 166/70 X |
| 3,004,599 | 10/1961 | Goodwin et al. | 166/292 |
| 3,216,500 | 11/1965 | Diehl | 166/70 |
| 3,299,953 | 1/1967 | Bernard | 166/285 |
| 3,362,477 | 1/1968 | Brandt | 166/305 |
| 3,613,790 | 10/1971 | Stout et al. | 166/294 |
| 4,246,967 | 1/1981 | Harris | 166/291 |

*Primary Examiner*—Stephen J. Novosad

[57] ABSTRACT

Drilling muds and waste fluids pumped to reserve pits and other on-site locations during drilling operations are recycled to the drilled well after the drilling operation is terminated and after the rig is removed from the site of the driling operations. The well is then plugged and abandoned without a rig on location.

6 Claims, 10 Drawing Figures

Fig. 1
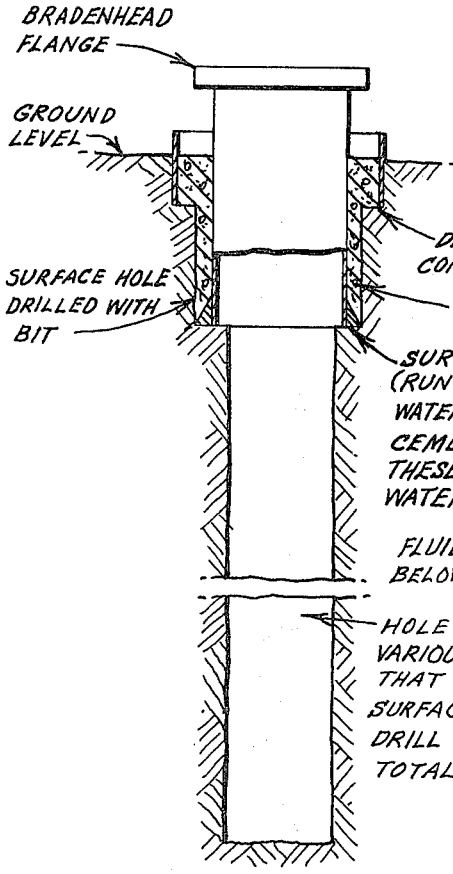
Fig. 2
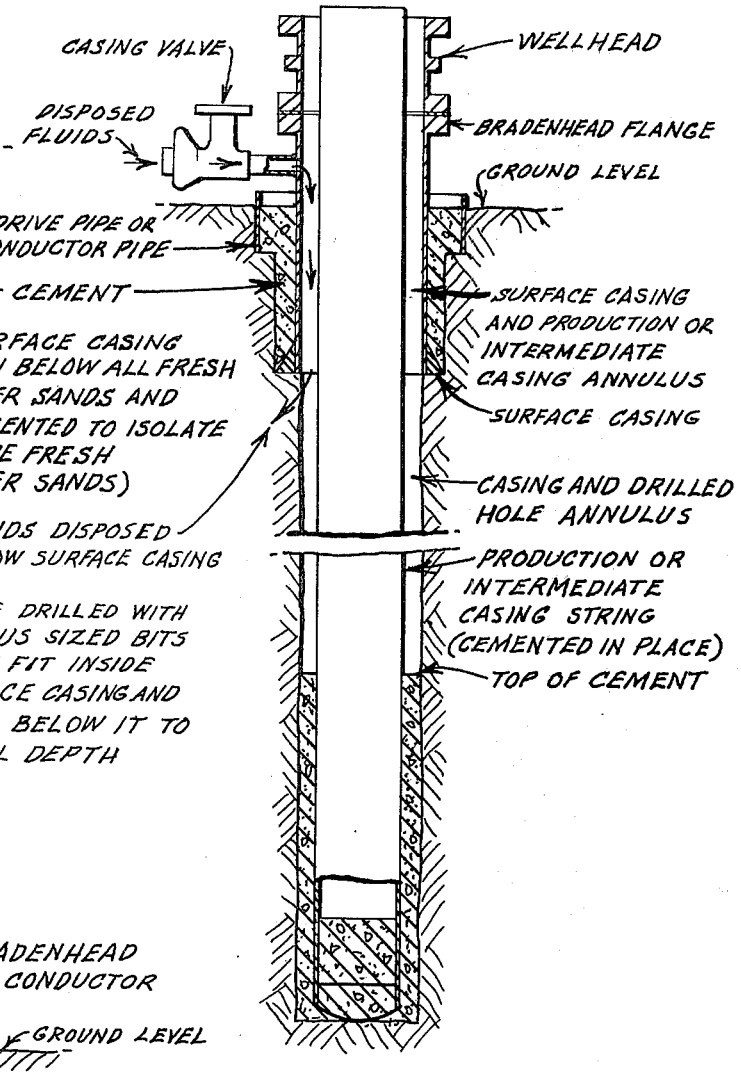
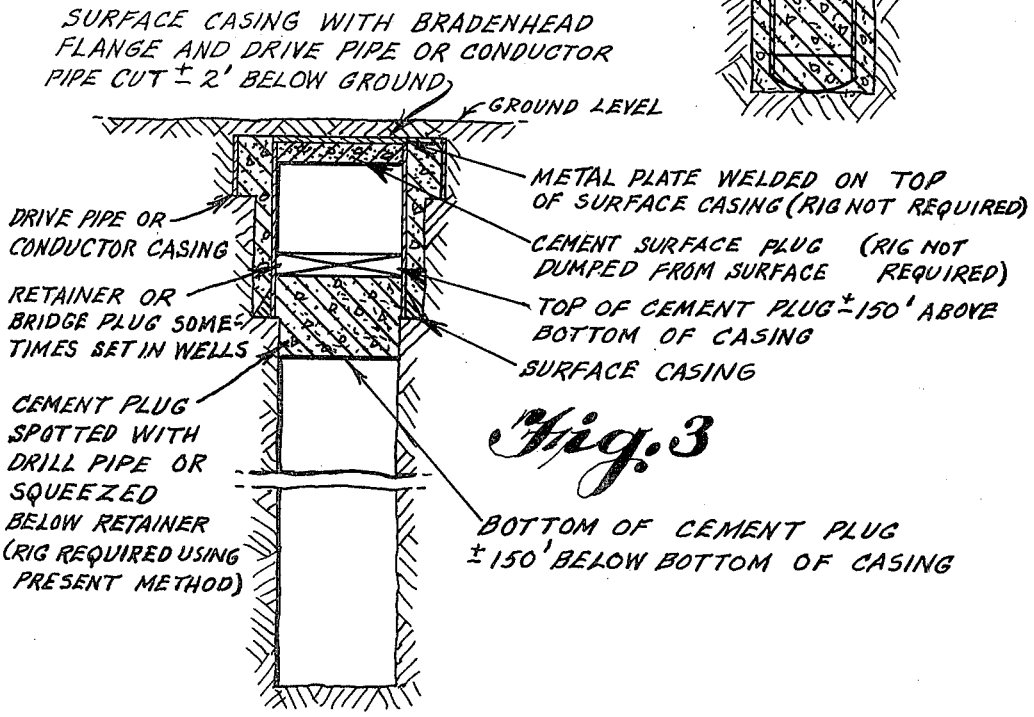
Fig. 3

METHOD AND APPARATUS FOR DISPOSING OF DRILLING MUDS AND WASTES GENERATED DURING WELL DRILLING OPERATIONS AND FOR PLUGGING AND ABANDONING THE WELL

FIELD OF THE INVENTION

The invention is directed to disposing of muds and fluids generated during well drilling operations and temporarily stored in reserve pits. Reserve pits are dug, before wells are drilled, and are used to dump excess drilling mud, drill water, oil, rain water and the like. At the end of the drilling operation, the reserve pit contents, as well as other fluids and muds on the location, must be disposed of before the reserve pits are backfilled and before the location is restored.

The volume of fluids to be disposed of varies. By way of illustration, it is noted that a small location and pits will contain approximately 10,000 barrels of fluids which must be disposed; even on a small location, large volumes must be removed. On-site pits may contain 50,000 and even 250,000 barrels of waste to be disposed. Because of these large volumes, disposal costs are high.

Using the drilled well, after drilling operations, to dispose of the fluids, is an option to keep disposal costs from escalating. In most well drilling operations, a string of casing, normally referred to as surface casing, is run in the well below all fresh water sands and cemented back to ground level. Thus, this surface casing isolates all fresh water sands from contaminants, thus making it ideal for disposal purposes.

SUMMARY OF THE INVENTION

The invention is directed to restoring well drilling locations by disposing of muds and fluids, generated during the well drilling operation, into the well itself and then plugging and abandoning the well without a rig on location. The invention provides a way to undertake the disposal in the absence of the drilling rig thereby reducing costs involved in rental of the rig and providing a simple method of disposal. The invention includes disposing of said waste muds and fluids down the surface casing or down through an intermediate string of casing contained by said surface casing and then plugging and abandoning the well without a rig. Since disposal is usually down through the surface casing, only the surface casing will be referred to below. However, it is intended that disposal down through such intermediate strings of casing is embraced by the invention.

BRIEF DESCRIPTION OF THE DRAWINGS

FIG. 1 illustrates a typical drilling well.

FIG. 2 is an illustration in which left-over drilling fluids can be injected below the surface casing if the well is found to be productive.

FIG. 3 is an illustration of a typical plugged and abandoned well.

Figure 9:
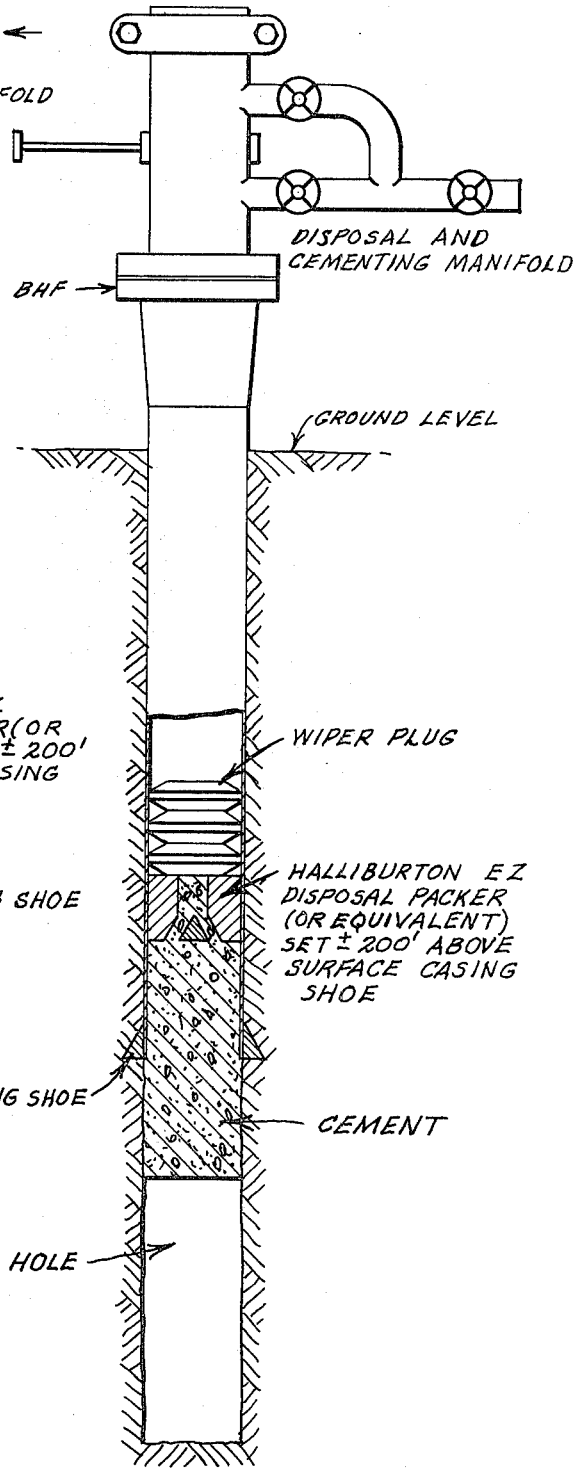

When the wiper plug hits the packer, as shown in FIG. 9, pump pressure measured at the surface increases and indicates that the cement is in place.

DETAILED DESCRIPTION OF THE INVENTION

The process of the invention can and is undertaken in wells drilled in formations including young soft rock, which allows water seepage back into the well bore. Obviously, the process may be undertaken in wells drilled in formations which do not allow water seepage back into the well bore. When the process is undertaken in the young soft rock formations, the process involves providing the surface casing with two pieces of equipment to undertake this process. Firstly, the surface casing is provided with a check valve, generally referred to as a "packer" in the art, which allows fluids to be pumped through it from the surface and which preferably also prevents fluids from coming up the well from below. Secondly, the surface casing is coupled at about ground level to a disposal, plugging and abandoning tree through which fluids, mud and cement can be introduced, hereinafter referred to as a DP&A tree. By contrast, if the process is undertaken in areas where seepage back into the well is unlikely, the check valve or packer need not be used. In an embodiment of the invention, the check valve or packer and said tree are coupled to the surface casing prior to removing the drilling rig from the drilling operation location although on some occasions, the DP&A tree can be installed after the rig has been released.

The check valve, hereinafter referred to as the "packer," is preferably one which prevents fluids from coming up the well from below but allows fluids to be pumped through it from the surface, sometimes designated as a packer with a back-pressure poppet valve or flapper valve. Although various packers are manufactured which could be employed, the "EZ Disposal" packer (manufactured by Halliburton) is one which has been used.

The preferred packers can be run in the well by conventional methods, either screwed on the end of the drill pipe or tubing (which is a light-weight tubular product used in completion operations after the well has been drilled) or on an electric wireline. Preferably, the packer is run in the well on the end of the drill pipe or tubing rather than on an electric wireline. Drill pipe is on the rig during normal operations and readily available. However, the invention might be practiced during completion operations with the tubing on the completion rig. Use of the drill pipe or tubing for setting the packer has advantages over use of the electric wireline for that purpose. The drill pipe or tubing can be lowered to exert weight on the packer to insure that it is set properly. In addition, by pressuring up on the drill pipe or the tubing and casing annulus, it is possible to determine whether the rubber packer elements or the casing has a leak. Neither packer integrity test can be run with the electric wireline.

When the packer is run in on drill pipe or tubing, the packer is screwed onto the bottom of the drill pipe or tubing and run in to a predetermined depth; in FIGS. 4 and 6–9, this depth is indicated to be ±200 feet above the bottom of the surface casing. However, the depth may range from ±50 to 200 feet above the bottom of the surface casing and may be any other selected depth outside that range. Having reached the predetermined depth, the drill pipe or tubing is rotated at the surface to engage a bottom set of slips on the packer to the casing. The drill pipe or tubing is then lowered, putting weight on said slips and compressing rubber elements against the casing, thus forming a seal; a second set of slips above the rubber elements engages the casing, keeping the rubber elements compressed. Then, the drill pipe or tubing can be released from the packer and pulled out of the well.

If run on an electric wireline, the packer is run to a predetermined depth on the wireline. An electric current from the surface sets off a charge in the packer, expanding the slips and compressing the rubber elements, thus setting the packer. After the packer is set, the wireline and setting tool are released from the packer and the wireline is reeled up on a spool at the surface of the well.

The second piece of equipment, the disposal, plugging and abandoning tree, is coupled to the surface casing at about ground level and will hereinafter be referred to as the DP&A tree. The DP&A tree includes means for coupling it to the surface casing; a tree body, otherwise referred to as a rubber wiper plug container; a means for holding a rubber wiper plug(s); a rubber wiper plug(s); at least one inlet below said wiper plug which during use allows the flow of fluids, muds and/or cements below said wiper plug which is secure in the DP&A tree. A full opening lubricator valve (optional) of predetermined size can be installed on top of the DP&A tree to allow various tools to be run in the well if pressure is encountered. The DP&A tree is fashioned after oilfield cementing plug containers.

The body of the DP&A tree can vary in size and is generally of a tubular configuration. Its inside walls define a cylinder which has the same or approximately the same diameter as that of the casing to which the DP&A tree is coupled and communicates with the interior of said casing. The DP&A tree may be made to dimensions sufficient to house more than one rubber wiper plug and means for holding the wiper plug in the DP&A tree.

The rubber wiper plug housed in the DP&A tree is the same plug which is used to cement casing in place. The plug is sized to conform to the inside of the casing to be plugged, and, in turn, can conform to the inside of the DP&A tree. The means for holding the rubber wiper plug in the DP&A tree is, in one embodiment, a retractable pin; when a retractable pin, the means for holding the wiper plug in the DP&A tree is also a means for releasing the wiper plug from the DP&A tree.

The DP&A tree is provided with at least one inlet which is situated below the wiper plug temporarily secured in position inside the body of the DP&A tree. The DP&A tree is preferably provided with two inlets (when one wiper plug is installed) which are manifolded, that is, the two manifolded inlets are defined by two communicating manifolded conduits. One of those two manifolded inlets is below the rubber wiper plug held in the DP&A tree, and the other of the two inlets is preferably above the said rubber wiper plug. In a preferred embodiment, flow of fluid, mud or cement through the inlet above the rubber wiper plug can force the rubber wiper plug through the DP&A tree and down the casing; the wiper plug forces all fluid and/or mud before it, through the packer. It is noted that each of the two conduits, defining the two manifolded inlets, is provided with valves for closing off or opening the inlet.

The means of coupling the DP&A tree to the casing includes preferably a flange. The flange is provided at one end of the DP&A tree body. The DP&A tree may be coupled to the surface casing in various ways. Universally, the surface casing is provided at about ground level with a bradenhead flange, sometimes referred to as the lowermost flange or starting flange; the bradenhead flange serves several purposes, such as to allow attachment of blowout preventers and/or of subsequent wellheads or a tubinghead. The bradenhead flange can be screwed on to the casing, but is normally slipped over the casing, usually the surface casing, and welded to the casing. Thus, the DP&A tree may be coupled to the surface casing by attachment to the bradenhead flange; by attachment to wellheads attached to the bradenhead flange; by attachment to tubingheads attached to the bradenhead flange; or, when the bradenhead flange is screwed onto the surface casing and removed, by direct attachment to the surface casing. Presently, the flange of the DP&A tree is attached to the bradenhead flange with nuts and studs; when nuts and studs are used, the flanges are provided with holes about their respective perimeters where the studs are run and tightened with nuts. However, conventional flanges and clamps such as Cameron clamp connections (Camloc) or "Grayloc" which are fashioned after Victaulic couplings may be successfully used. In some cases, an adapter flange may be required between the bradenhead flange or subsequent wellheads and the DP&A tree; although the flange of the DP&A tree may have approximately the same inner diameter as the bradenhead flange or subsequent wellheads, their configurations may be different, thus requiring an adapter flange between the two. A metal ring gasket is employed between flanges to prevent leakage; the metal ring gasket is inserted in ring grooves cut all the way around, e.g., the bottom of the flange inside the stud holes.

The DP&A tree is designed with a burst rating well above the casing on which it is utilized. Thus, when positioned on well casing, it controls pressure developing in the well. The DP&A tree is designed so that the top can be removed, exposing a full opening through which additional wiper plug(s), packer(s), or bridge plug(s) can be run. The top of the DP&A tree may be fitted with a 2-inch (or various sizes) flange so that a 2-inch (or various sizes) full-opening lubricator valve could be installed if desired. Then a pressure lubricator could be installed so that appropriate equipment (coiled tubing, wire-line tools, etc.) could be run in the well if there was pressure on the well.

In a preferred embodiment, the packer and the DP&A tree are coupled to the well casing prior to release of the drilling rig from the well. (DP&A tree could also be installed after the rig has been released.) Once the packer and DP&A tree are attached to the well, waste fluids and muds or cement can be alternately injected into the well. In accordance with the invention, the drilling rig is released from the well prior to undertaking the disposal, plugging and abandoning process.

The disposal stage of the process involves transferring the contents from the reserve pit(s) to one of the inlets of two manifolded inlets of the DP&A tree, through conduits not depicted, and injecting into the well casing. In a specific embodiment, the transfer involves using low pressure pumps to remove the contents from the reserve pit(s), cleaning the fluid and muds, and pumping the cleaned fluid with a positive displacement pump capable of injecting under pressure.. The contents of the reserve pit(s) are removed from the pit(s) using tractor pumps, trash pumps or various sludge pumps, all of which are low pressure pumps. Then the contents are filtered through a "Shale Shaker" or other type of mud cleaner which is a set of vibrating fine-mesh screens which removes large particles. The cleaned reserve pit contents fall into a metal suction pit and then can be pumped to the DP&A tree with a high pressure positive displacement pump. A particular pump which is employed is a Gardner Denver PAH which is capable of pumping six to eight barrels per minute at approximately 2000 psi. Generally, injection pressure are well below 2000 psi. The reserve pit contents are pumped into the DP&A tree under the wiper plug contained in the DP&A tree, down the casing, through the packer and into the formation at the bottom of the surface casing. When fluids have been pumped off the location, the well is ready to be plugged and abandoned.

The plugging stage of the process involves pumping a sufficient amount of cement into the casing which forms a cement plug(s), one of which may extend above and below the bottom of the surface casing, for example, a plug extending approximately 150 feet below the surface casing and approximately 150 feet above the bottom of the surface casing. After all of the cement has been pumped through the DP&A tree, a rubber wiper plug is inserted into the casing to push all cement before it down the inside of the casing, and when the casing is equipped with a packer, to push the cement through the packer. When preferably the DP&A tree is provided with two manifolded inlets, one being above the plug, the manifold is switched so that fluid is pumped on top of the rubber wiper plug through the manifold inlet above the rubber wiper plug (fluid could be water and/or even additional cement): the retractable pin holding the wiper plug is removed, and fluid (water, cement, and/or mud) is pumped on top of the rubber wiper plug to push it down the casing where it will rest on the packer. Pump pressure measured at the surface will increase to signify that the cement plug(s) is in the proper place to conform with the regulations of the governing regulatory bodies. Upon bumping the plug, the DP&A tree can be removed from the bradenhead flange, unless pressure is to be held on the plug for a time to allow the cement to set up under pressure.

The volumes of cement, used in plugging, and the size of the cement plug, will vary depending on the size of the surface casing, the number of cement plugs to be set, the length of the cement plug(s), the type of cement slurry used, all of which depend on regulations imposed by the governing regulatory body in the district of the drilling operation. The following parameters are given by way of example, as other parameters may satisfy regulations controlling in the district of the drilling operation.

The plugs can be set with Class "H" cement mixed to about 15.6 lb/gal to produce a slurry yield of 1.17 $ft^3$/sack (cement types, mixing weights and slurry yields are usually at the discretion of each operator). If a hydrocarbon show is detected below the surface casing and is later determined to be non-commercial, an initial cement plug must usually be provided which extends a minimum of 100 feet below and 100 feet above the show (a show is an indication of oil or gas); in other words, a cement plug which is at least about 200 feet. These plugs below the surface casing must be set with the drilling rig in place, prior to setting the disposal packer. If only one plug is required below the surface casing, the next plug should extend a minimum of 100 feet below the surface casing and a minimum of 100 feet into the surface casing. As an example, a final plug can be set in top of the surface casing below ground level and extending for 50 feet.

A typical set of equations for determining cement volumes required to plug a well for common casing and hole size will be set forth using the foregoing parameters. The following assumptions are made: (1) $10\frac{3}{4}''$ surface casing is set at 3000 feet and a $9\frac{7}{8}''$ hole drilled below it to 10,000 feet. (2) A non-commercial hydrocarbon show is encountered at 5000 feet; and (3) one 300-foot cement plug will be required from 4850 feet to 5150 (extending 150 feet above and 150 feet below the show) feet in the $9\frac{7}{8}''$ hole. (4) The cement used is Class "H," mixed to 15.6 lb/gal which gives a 1.17 $ft^3$/sack yield. From tables, it is known that:

$9\frac{7}{8}''$ hole=0.5319 $ft^3$/ft $10\frac{3}{4}''$ casing=0.5509 $ft^3$/ft ($10\frac{3}{4}''$ CSG, 40.50 lbs/ft).

Thus, for a 300-foot open hole plug, the following sacks of cement will be required:

$$300 \times 0.5319 \frac{ft^3}{ft} \times \frac{1}{\frac{1.17\ ft^3}{sacks}} = 136 \text{ sacks.}$$

Thus, in this illustration, it would take 136 sx (sacks) of Class "H" cement to spot in the open hole, with drill pipe from 4850 feet to 5150 feet, prior to setting the disposal packer at 2850 feet and installing the DP&A tree. After releasing the rig and disposing the fluids, two cement plugs will be set; for an example, in accordance with this illustration, one from 2850 feet to 3150 feet (150 feet below the surface casing extending 150 feet into the surface casing) and one from 10 feet to 60 feet (a 50-foot plug at the top of the $10\frac{3}{4}''$ casing).

Using the same equations, the plug at 2850 to 3150 feet will require $$150\ ft \times 0.5319\ ft^3/ft \times \frac{1}{\frac{1.17\ ft^3}{sacks}} = 68.19$$

sacks for the 150 feet portion of the plug in the $9\frac{7}{8}''$ hole, and $$150\ ft \times 0.5509\ ft^3/ft \times \frac{1}{\frac{1.17\ ft^3}{sacks}} = 70.62$$

sacks for the 150 feet portion in the $10\frac{3}{4}''$ casing for a

Total: 68.19+70.62=139 sacks. For the plug extending from 10 feet to 60 feet (at the top of the surface casing), for 50 feet in the $10\frac{3}{4}''$ casing, the amount of cement will be $$50\text{ ft} \times 0.5509\text{ ft}^3/\text{ft} \times \frac{1}{\frac{1.17\text{ ft}^3}{\text{sacks}}} = 23.54$$

sacks. Thus, the three plugs would require approximately 299 sacks of cement. The foregong determinations are illustrative only, as plugging requirements will vary from well to well. Specific requirements for plugging and abandoning are checked prior to installing the disposal packer and to pumping cement.

As indicated above, measurements or pressure build-up at the surface when the rubber wiper plug bumps the packer will signify that the cement is in place. In fact, generally pressure is monitored constantly with various pressure gauges when disposing of fluids, when mixing cement, and when displacing cement and the rubber wiper plug. These gauges are checked regularly and are downstream of the injection pump. Barrel counters are generally used when displacing the wiper plug. From the foregoing illustrative equations to determine cement plugging volumes, it will take, with the disposal packer set at 2850 feet, approximately 280 barrels of fluid (capacity of $10\frac{3}{4}''$ casing) to displace the plug to the packer. When the barrel count approaches 280 barrels, the plug should bump up on the packer; the opening that the fluid is pumped through is plugged up by the plug; fluid is compressed; and the pressure gauges at the surface indicate pressure increase. This pressure can be held a sufficient time to allow the cement to set up.

At this point, the DP&A tree can be uncoupled from the casing. Plugging and abandoning operations can be continued by cutting the surface casing and drive pipe or conductor pipe (if used) several feet below ground level; removing the bradenhead flange; dumping the surface cement plug (if required); welding the plate on top of the surface casing; and covering up the well in accordance with convention.

The invention allows for the disposal of reserve pit(s) contents after the drilling rig has been released from the well, and thus simplifies the disposal procedure and obviates drilling rig costs to plug and abandon which requires an average of 8 to 12 hours of rig time, which presently amounts to as much as 4000 to 6000 dollars.

DESCRIPTION OF SPECIFIC EMBODIMENTS

In accordance with the invention, the surface casing may be used for disposal of said waste fluids and muds generated during drilling operations after the drilling rig has been released from the well.

The explanation of FIGS. 1–3 below is presented to illustrate how waste fluids and muds are generated during drilling operations and to set forth the background of the invention. FIGS. 1–3 present specific embodiments for purposes of clarity; it is understood that these embodiments have various known equivalents and encompass modifications thereof which would not alter their function or purpose.

FIG. 1 illustrates a typical drilling well. To start drilling operations, normally a string of casing known as drive pipe or conductor pipe is driven with a pile driver (diesel hammer) or a hole is drilled with a rat hole machine to a shallow depth, and the casing run and cemented. Either method can be performed prior to moving in a drilling rig. Drilling operations begin inside this drive pipe or conductor pipe with a suitable bit size to drill the surface hole. When a predetermined depth below all fresh water sands, surface casing (various sizes) (1) is run in the hole and cement is put around the pipe from the bottom of the casing all the way back to ground level, thus isolating the fresh water sands. A flange called the bradenhead flange (2) is welded or screwed on top of the surface casing (1) and the blowout preventers (not specifically shown) nippled to this flange. A bit is then run through the blowout preventers, inside the surface casing; and drilling is continued below the casing to a predetermined depth, mud weight or pressure. At this depth the well is evaluated and production casing run if the well is good. If the well is dry, it is plugged and abandoned (a process to be discussed later); or intermediate casing can be run, if required, and drilling continued to a deeper depth.

FIG. 2 is an illustration in which left-over drilling fluids can be injected below the surface casing if the well is found to be productive. A string of casing, known as production casing (sometimes known as intermediate casing), can be run in the well, below the surface casing. In most cases this string is run and cemented from the bottom up; the cement is rarely as high as the bottom of the surface casing. Thus, an annulus between the two strings of casing allows access to inject the fluids to be disposed of below the surface casing. After the drilling rig (not illustrated) is released, an injection pump can be used to dispose of fluid down this annulus through the casing valve.

If the well as shown in FIG. 1 proves to be dry or non-commercial, disposal of the fluids left on location is more costly because, according to current practices, they must be injected down the casing with the rig on location or they must be trucked off and disposed of after the rig has been released. If the well is used for disposal of fluids with the rig on location, costs of $10,000 to $12,000 per day are encountered. The volumes of waste fluids we have are sizeable, as suggested above, and the rig may be required from five days to several months. Therefore, this type of well is normally plugged and abandoned at this stage; and the fluids left over from drilling operations are trucked off and disposed of at approved disposal areas. In either case the cost to dispose of the fluids will be approximately five dollars per barrel (at present rates) due to rig costs or trucking and disposal fees.

FIG. 3 is an illustration of a typical plugged and abandoned well (however, there are many alternate ways a well can be plugged and abandoned); the plugging and abandoning operation is presently performed by the drilling rig (not shown). In this example of a plugged and abandoned well, a cement plug extending approximately 150 below and 150 feet inside the bottom of the surface casing is either put in place using the drill pipe to spot the cement or to squeeze the cement below a cement retainer set 150 feet above the bottom of the casing. The surface casing with the bradenhead flange and the drive pipe or conductor pipe is then cut approximately 3 feet below the ground level. In this example, a cement plug called the surface plug is dumped in the top of the surface casing, and a metal plate is welded over the top of the surface casing. The well is then covered over with dirt. This plug and abandoning operation is presently performed with the drilling rig on location and thus is relatively expensive (such a plugging and abandoning operation would require 8–12 hours of rig time). After the well is plugged and abandoned it cannot be used for disposal purposes. However, it is too expensive to dispose of the fluids with the drilling rig on location prior to plugging and abandoning the well.

FIGS. 4–9 represent embodiments of various stages, and the apparatus used therein, for mud and fluid disposal from reserve pit(s) into the well, after the drilling rig has been removed from the well, in accordance with the invention.

Figure 4:
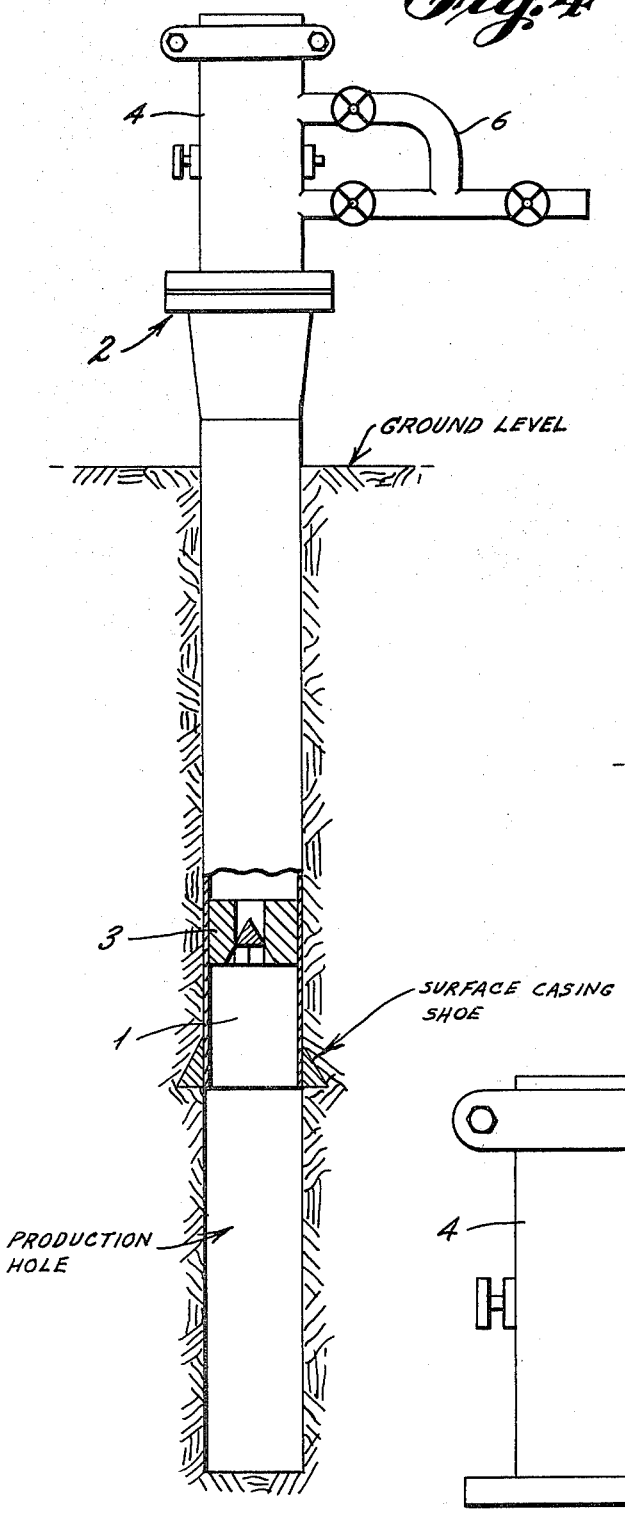
FIG. 4 illustrates an embodiment of the well set-up prior to moving the drilling well off so that the method of the present invention can be performed.

FIG. 4 illustrates an embodiment of the well set-up prior to moving the drilling rig off so that the new method of disposing, plugging and abandoning of the well can be performed. The well set-up in FIG. 4 involves two pieces of equipment and is a set-up typically employed when drilling is undertaken in formations including young soft rock. The first is a packer (3) (e.g., Halliburton EZ Disposal Packer), which is a common piece of oilfield equipment and performs as a check valve which prevents fluids from coming up the well from below but allows fluids to be pumped through it from the surface. The second piece of equipment is a specially designed disposal, plug and abandoning device which is a disposal, plugging and abandoning tree (4).

The disposal, plugging and abandoning tree, hereinafter referred to as DP&A tree, is specifically shown in FIG. 5. It is fashioned after common oilfield cementing plug containers and fastens onto the bradenhead flange via coupling means 5. Inside the DP&A tree is a rubber wiper plug which is the same plug used to cement casing in place. The plug is held in the top of the DP&A tree by a retractable pin. In the embodiment of FIG. 5, as well as of FIG. 5*a*, the inlets into the side of the tree are manifolded, permitting fluid to be injected below or above this wiper plug depending on which phase of the operation is being performed. That is, the two inlets into the side of the tree are defined by two conduits which are manifolded and together can be referred to as the disposal and cementing manifold (6). The height of the tree can be varied to accommodate additional wiper plugs, retractable pins and manifolded inlets.

Figure 5A:
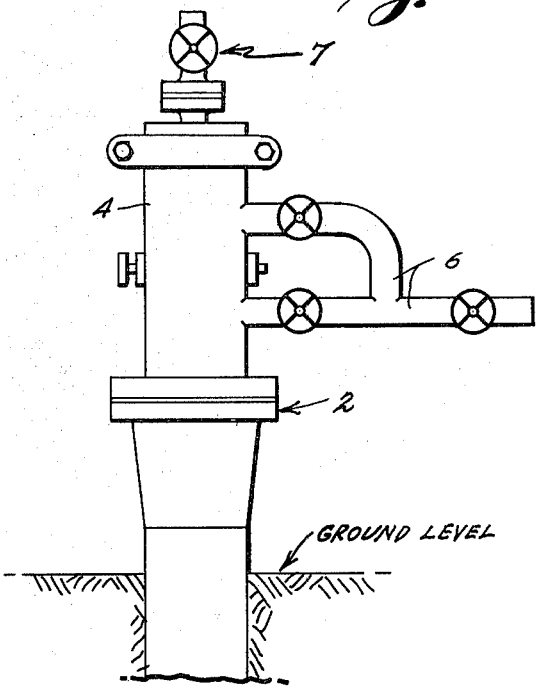
FIG. 5*a* shows the DP&A tree modified with a conventional lubricator valve.
Figure 5:
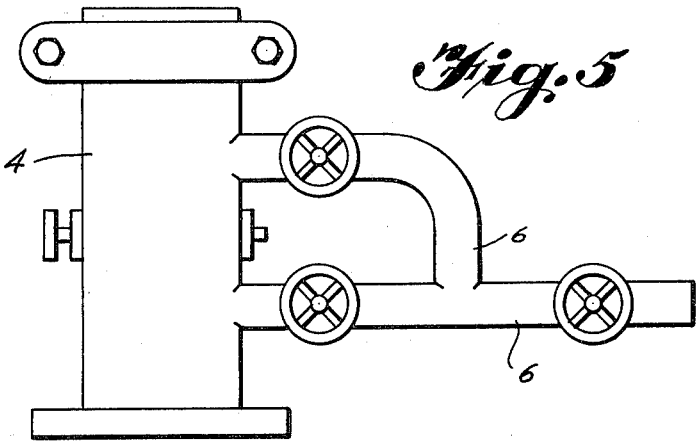
FIG. 5 illustrates the disposal, plugging, and abandoning tree, herein referred to as the DP&A tree.

FIG. 5*a* shows the DP&A tree modified with a conventional lubricator valve (7) discussed below. This FIG. 5*a* is presented to emphasize that although the DP&A tree is essential to the invention, modification of the DP&A tree is intended without departing from the scope of the invention.

Figure 6:
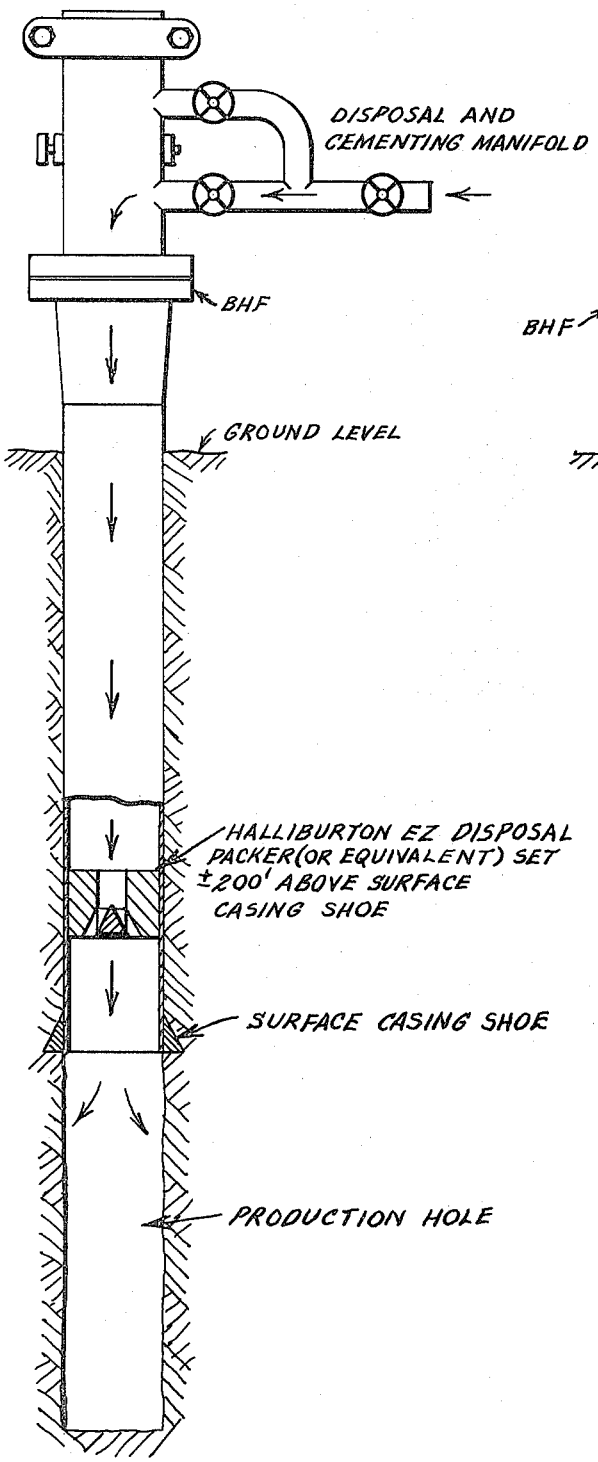
FIG. 6 shows the path of muds and fluids through the manifold below the wiper plug, down the surface casing, through the packer, and into the formations at the bottom of the surface casing.

FIG. 6 shows the path of muds and fluids through the manifold below the wiper plug down the surface casing through the packer and into the formations at the bottom of the surface casing, in accordance with an embodiment of the invention. An injection pump is coupled to the manifold to inject the muds and fluids.

Figure 7:
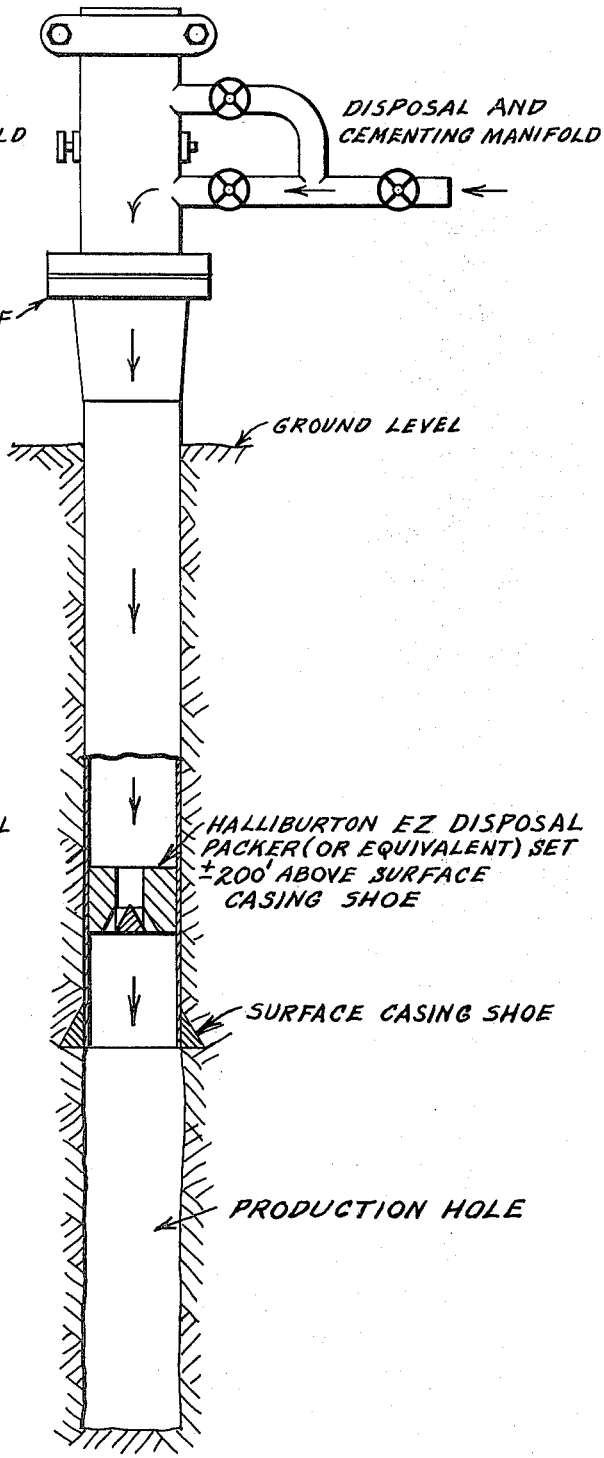
FIG. 7 shows the path taken by cement into the well.

FIG. 7 shows the path taken by cement pumped into the well.

Figure 8:
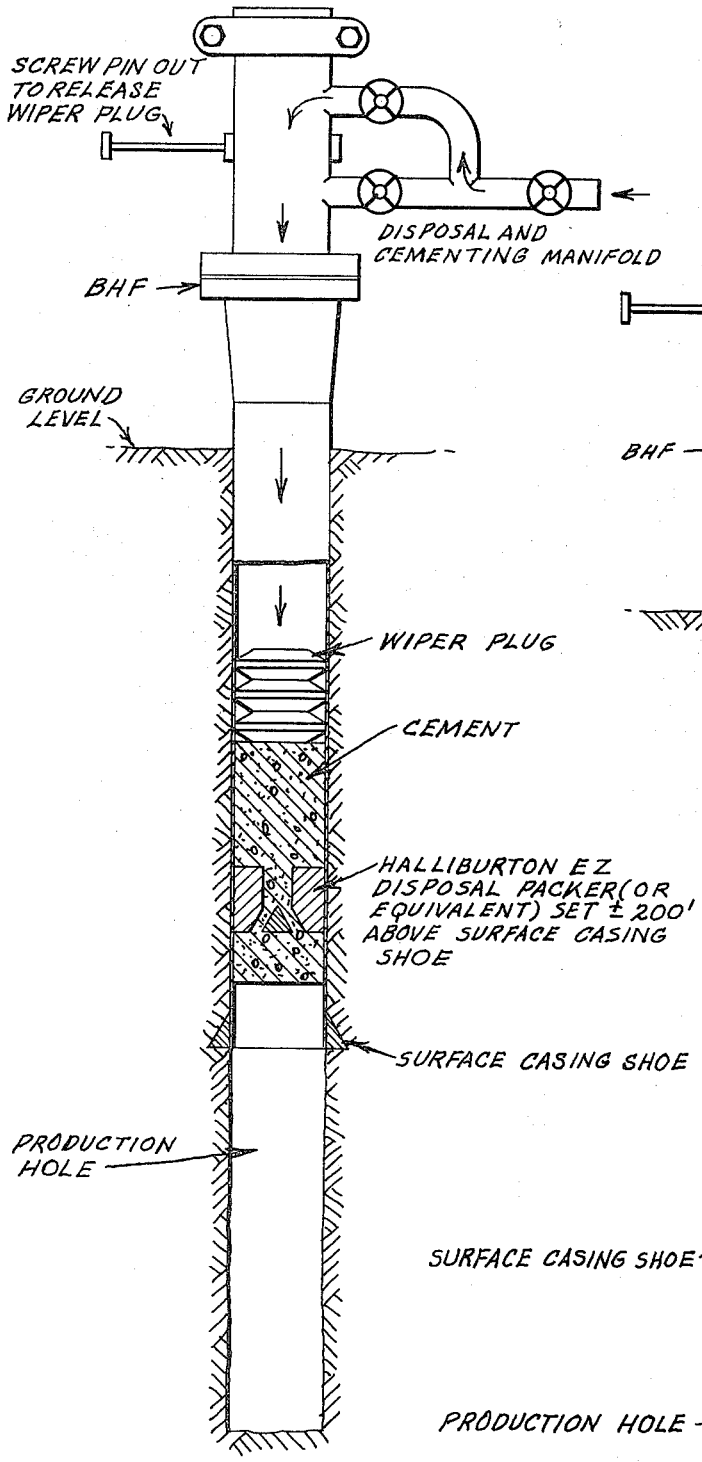
As illustrated in FIG. 8, after all of the cement has been pumped through the manifold, the manifold is switched (the lower manifold valve is closed and the upper manifold valve is opened) and the retractible pin is screwed out so that fluid is pumped on top of the rubber wiper and the plug is released and displaced down to the packer.

As illustrated in FIG. 8, after all of the cement has been pumped through the manifold, the manifold is switched (the lower manifold valve is closed and the upper manifold valve is opened) and the retractable pin is screwed out so that fluid is pumped on top of the rubber wiper and the plug is released and displaced down to the packer, whereby the cement is displaced through the packer. When the wiper plug hits the packer, as shown in FIG. 9, pump pressure measured at the surface increases and indicates when the cement is in place to conform with the regulations of governing regulatory bodies. Cement may be pumped on top of the wiper plug and additional plugs may be spaced out and spotted above the wiper plug if required. Then the upper and lower manifold valves are closed, and the cement company is removed. The well may then be abandoned.

Specific embodiments have been presented by way of explanation. However, it is intended that modifications and equivalents of said embodiments recognized by those in the art, are encompassed by the appended claims.

What is claimed is:

1. A method for restoring the location of a drilling well operation by directing muds and waste fluids generated during the drilling operation and temporarily stored on the drill site, whereby the muds and waste fluids are pumped into the surface casing of the well after the drilling rig has been released from the well, the method comprising coupling the surface casing at about ground level with a rubber wiper plug container which has the same or approximately the same inside diameter as the inside diameter of the surface casing prior to or after releasing said drilling rig;

wherein said rubber wiper plug container contains at least one rubber wiper plug and means to temporarily secure said rubber wiper plug inside the container wherein said rubber wiper plug is sized to conform to the inside of the surface casing;

wherein said rubber wiper plug container is provided with at least one inlet, wherein said inlet is in communication with the inside of said rubber wiper plug container at a position below the position of said rubber wiper plug;

injecting into said inlet at a position below said wiper plug, said muds and waste fluids and then injecting a slurry of cement through said inlet in an amount sufficient to plug said well; then releasing the rubber wiper plug and inserting fluid over the wiper plug into the surface casing to push the slurry of cement down through the inside of said casing; and removing said rubber wiper plug container from the surface casing.

2. The method of claim 1, wherein said surface casing is provided with a check valve which allows fluids to be pumped through it and which prevents fluid from coming up the well.

3. The method of either claim 1 or claim 2, wherein said rubber wiper plug container is provided with two inlets and wherein one of said inlets communicates with the inside of said rubber wiper plug container at a position above the position of said rubber plug in said rubber wiper plug container; wherein fluid which is mud, water, additional cement, or mixtures thereof is pumped into the container over the rubber wiper plug, through said inlet above said wiper plug, to force the rubber wiper plug down into the surface casing wherein the rubber wiper plug forces cement down the inside of the casing.

4. The method of claim 3, wherein the rubber wiper plug forces cement through the check valve.

5. A system for disposing of muds and fluids, generated during well drilling operation, comprising:

a surface casing of said well;

a means for allowing fluids to be pumped through it and for preventing fluids from coming up the well, said means disposed down said surface casing and secured in position;

an apparatus coupled to the surface casing at about ground level, said apparatus comprising:

a first means for holding a rubber wiper plug, the inside of said first means being cylindrical and having approximately the same diameter as the cylinder defined by the inside walls of said surface casing;

a rubber wiper plug sized to conform to the inside of said surface casing;

means for temporarily securing the rubber wiper plug in said first means;

at least two inlets communicating with the inside of said first means, one of said two inlets communicating with the inside of said first means below the position of the rubber wiper plug secured in said first means; and coupling means including a flange for coupling said first means to the surface casing thereby allowing for release of the drilling rig from the well during the disposal.

6. The system of claim 5, wherein said apparatus includes two manifolded conduits which define the two inlets, wherein the other of said inlets communicates with the inside of said first means at a position above the rubber wiper plug secured in said first means.

* * * * *

UNITED STATES PATENT AND TRADEMARK OFFICE

CERTIFICATE OF CORRECTION

PATENT NO. : 4,429,746
DATED : February 7, 1984
INVENTOR(S) : Gerald D. Allard

It is certified that error appears in the above-identified patent and that said Letters Patent are hereby corrected as shown below:

Col. 1, line 61, should read -- prior to moving the drilling rig off . . . . --.

Col. 5, line 21, should read -- Gardner Denver PA8 --.

Signed and Sealed this

*Twelfth* Day of *June 1984*

[SEAL]

*Attest:*

GERALD J. MOSSINGHOFF

*Attesting Officer*

*Commissioner of Patents and Trademarks*